United States Patent [19]

Cohen et al.

[11] 4,246,954

[45] Jan. 27, 1981

[54] CASTING TREE FOR TANDEM MOLD PREPARATION AND METHOD OF USE THEREOF

[75] Inventors: Abraham M. Cohen, Albertson; Henry L. James, Regal Park, both of N.Y.

[73] Assignee: Wasko Gold Products Corp., New York, N.Y.

[21] Appl. No.: 8,533

[22] Filed: Feb. 1, 1979 (Under 37 CFR 1.47)

[51] Int. Cl.[3] ..... B22D 18/06; B22D 25/00

[52] U.S. Cl. ..... 164/35; 164/63; 164/129; 164/244; 164/246

[58] Field of Search ..... 164/35, 129, 244, 246, 164/249, 350, 376, DIG. 4, 94–96, 63

[56] References Cited

U.S. PATENT DOCUMENTS

| | | | |
|---|---|---|---|
| 726,000 | 4/1903 | Slattery | 164/96 X |
| 3,648,760 | 3/1972 | Cooper | 164/244 |
| 4,161,208 | 7/1979 | Cooper | 164/246 X |

*Primary Examiner*—Robert D. Baldwin

*Attorney, Agent, or Firm*—McAulay, Fields, Fisher, Goldstein & Nissen

[57] ABSTRACT

A casting tree for preparing a tandem mold suitable for sequential casting, within the same casting flask, of both white and yellow gold portions of jewelry items has a base with a main stem extending upwardly from the base. In addition, a secondary stem is also provided and extends from the base to an upper portion of the main stem. Both stems are formed of a fusible material generally termed as "casting wax." Disposed through the central portion of the main stem, between the base and the upper portion to which the secondary stem extends, is a piece of non-fusible material, preferable a ceramic disc.

When the subject invention tree is used in an investment casting process, the casting mold formed thereby comprises a tandem mold divided by a non-fusible separator, each portion of the mold having a separate passage communicating therewith whereby two different types of material, for example, a white gold and yellow gold, can be separately cast using one flask.

16 Claims, 7 Drawing Figures

CASTING TREE FOR TANDEM MOLD PREPARATION AND METHOD OF USE THEREOF

BACKGROUND OF THE INVENTION

1. Field of the Invention

This invention relates, generally, to a lost wax casting tree and the method of use thereof, in an investment molding process. More particularly, the invention relates to a casting tree which permits forming both white gold and yellow gold portions of a jewelry item, such as a ring, within a single flask, utilizing otherwise standard equipment.

2. Description of the Prior Art

The lost wax/investment molding procedure has found considerable application in dental, jewelry and allied fields where the precise reproduction of an article, as represented by an expendable pattern, is desired.

The process is generally characterized by the formation of a wax or plastic pattern which is embedded in a mixture of refractory investment materials. The resulting pattern is then subjected to heat, in order to drive out moisture from the investment material, to harden it and to melt the wax or plastic from the pattern. Finally, the molten material which is to be cast in the mold is poured into the investment material die and, when the molten material has sufficiently cooled, the die is removed leaving a precise reproduction of the article originally represented by the wax or plastic pattern.

For the purposes of this application, the terminology "wax" or "plastic" is intended to include all those materials which are normally used or are suitable for use in the various lost wax casting processes to which the present invention relates.

The use of a soft material, such as waxes or plastics normally employed in lost wax casting processes, gives considerable leeway to the person preparing the casting as these materials are easily worked. Thus, an artist can sculpt his idea in wax and thereafter have it precisely executed in gold or other suitable material. The ease with which the lost wax techniques can be applied have made them useful for dentists in casting the filling for a cavity or replacing a tooth. Wax can be pressed into the cavity of a tooth, once the cavity has been cleaned, to form an exact duplicate of the cavity. This wax model is then used to form an investment material die wherein gold or other material may be cast to produce a filling for the tooth.

In order to cast molten metal into a prepared mold, a conduit leading to the mold is usually formed. This is accomplished by attaching a piece of fusible material, such as a rod of wax or plastic, to the item being cast. When the wax or plastic is removed a conduit to the mold is formed.

One method of forming the conduit leading to the mold is to attach a rod of the wax or plastic material, known as a sprue, to each wax pattern, and form the casting mold or flask about these individual patterns. The molten gold or other material is then poured into a funnel shaped cavity formed near the surface of the mold, in communication with each sprue or rod. The use of a sprue or sprues is shown, for example, in connection with the formation of various dental castings in U.S. Pat. No. 1,595,338 to Brazda et al.

An improved sprue device which can be adjusted to support various size patterns by bending a U-shaped double sprue to form a wider or narrower "U", as required by the extent of the pattern, is shown in U.S. Pat. No. 2,468,479 to Barishman. This also provides two passages through which molten material can flow to the pattern. U.S. Pat. No. 3,610,317 to Benfield, again shows the use of a sprue or plurality of sprues, each attached to a wax pattern to form conduit to the mold formed by the wax pattern.

A sprue may either be of a fusible material which can be melted from the investment mold, or of a metal which must be withdrawn to permit the wax or plastic used to form the pattern to flow out of the investment mold.

The use of a second sprue which may communicate with one or more of the wax patterns to form a second conduit for the molten material is also shown in Benfield. This second conduit helps to insure complete filling of the pattern especially where there are thin sections in the pattern which might prematurely block the flow of molten material through the main sprue formed conduit. U.S. Pat. No. 3,322,187 to Weissman shows a still further arrangement wherein conduits are formed to a number of patterns by a separate sprue associated with each pattern. U.S. Pat. No. 2,065,977 to Jefferies, although generally concerned with a method of vibrating the investment materials to form a tight mold, again shows the basic technique of the use of sprues to form conduits directly to the wax patterns.

The present invention is intended to be particularly useful in the preparation of parts for forming jewelry and therefore mention is made of U.S. Pat. No. 1,389,315 to Moats. Moats teaches a method whereby a minimum number of different parts can be used to form rings of different sizes. A single inlet conduit which is formed in the mold can be used to pour a single molten material into two molds at the same time.

Although utilizing basically the same technique, it has been found advantageous to cast a larger number of small items in a vertical mold than was previously attainable by the use of individual sprues extending from the opening in the mold, so that a larger number of items are formed from the same casting operation with a minimum of equipment and a minimum of waste of investment molding material. Basically, this is accomplished by forming a "tree" of a fusible material to which is attached the various wax or plastic patterns by means of individual sprues. The result is a single stem which forms a central conduit extending generally vertically into the investment material, with a number of branches extending therefrom to the individual patterns. In general, the tree is formed by first attaching a sprue to the wax or plastic model and then attaching the other end of the sprue to the central stem by the addition of wax or by melting or otherwise. With various modifications in the equipment used or the technique employed, this basic process is shown in U.S. Pat. No. 3,648,760 to Cooper with reference to dental casting; and in U.S. Pat. No. 3,402,755 to Christian, with reference to jewelry articles in general.

It has recently become popular to have jewelry, and in particular rings, formed of both white and yellow gold. This is normally accomplished by separately casting the yellow gold portions and the white gold portions of the jewelry piece and thereafter assembling the portions by soldering or other usual means.

Several practical problems are encountered when this type of jewelry is being made. These problems are associated with the fact that each part must be separately cast and the various parts thereafter matched to each other and assembled. For example, many jewelry items are formed of individualized parts or pieces that are not interchangeable. This requires that some accurate inventory method be used to assure that the right parts come together so that the person assembling them can work effectively. Even when a large number of interchangeable parts are involved, separate casting of each part still requires that there be some inventory method used to insure that the various parts are properly brought together.

Because normally small quantities of jewelry pieces are being made, the cost of a double operation wherein first the white gold pieces and then the yellow pieces are cast, is considerable. In addition, because of the nature of the process, there is considerable waste of investment material in completing a small number of items.

One prior attempt to solve this problem is to first cast the white gold (higher melting material) portion of the ring or other jewelry. The cast white gold portion is then attached to the wax model of the yellow gold (lower melting material) portion to form the combined model which includes the yellow gold mold. When the wax is removed from the investment mold, the white gold portion remains to be fused to the molten gold poured into the mold. Although this solves the problems of inventories of unassociated parts, it introduces unacceptable new problems:

1. There is a considerable waiting period (as much as four hours) for the completion of the first casting step to produce the white gold part, before the combined model can be assembled and thereafter made ready to cast the yellow gold portion to form the complete item. Until the first casting step is completed, the yellow gold portion of the mold is just sitting on the production line, without being worked on, thereby increasing the production time for the complete item and increasing the manufacturing cost.

2. In the curing of the investment material to form a mold, it is baked in an oven. This baking step oxidizes the white gold piece to a black color which is difficult to remove and leaves a white gold piece which never really looks right.

3. The prolonged time that the white gold piece is kept in the oven until curing of the yellow gold portion of the mold causes the white gold piece to become disfigured.

Therefore, the present invention has as a main object to provide a means, and method of using the means, whereby two different materials, and in particular white gold and yellow gold, can be cast in the same flask with sequential pourings of the two molten metals.

It is a related object and feature of the present invention to provide a tree for preparing a tandem mold wherein metals of different melting points can be separately cast.

It is a still related object, feature and advantage of the present invention to provide a mold wherein different parts of a single item may be cast in different materials in the same casting flask.

BRIEF DESCRIPTION OF THE DISCLOSURE

Briefly, a tree according to the present invention, for preparing a tandem mold, comprises a stem formed of fusible material having a first portion and second portion separated by a non-fusible separator. The stem projects upwardly from a base and is normally provided with an enlarged foot whereby the finished mold has an enlarged inlet or mouth for pouring molten material therein. An auxiliary branch is also provided to extend between the base and the second or upper portion of the stem. As with the stem, the auxiliary branch is advantageously provided with an enlarged foot.

In use various wax or plastic patterns are attached to the first and second portions of the stem by short sprues. Normally the item to be cast of the higher melting alloy or other casting materials are attached to the upper portion of the stem. The stem and base are then surrounded by a collar and the usual investment material packed thereabout to form the mold by essentially usual procedures.

The resulting mold will comprise a main conduit divided into two portions. The first portion is in communication with the part of the mold formed by the foot of the stem and the second portion is in communication with the part of the mold formed by the foot of the branch. The completed mold is freed of the fusible material tree and patterns; inverted; and each molten casting material poured into the appropriated portion of the mold.

Additional features of the invention will be more fully appreciated from a more detailed description of the invention taken in conjunction with the accompanying drawings.

DESCRIPTION OF THE PREFERRED EMBODIMENTS

Figure 1:
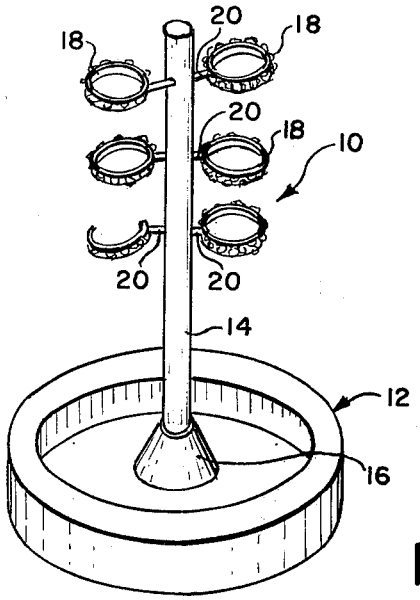
FIG. 1. PRIOR ART
FIG. 1 is a perspective view of a tree formed on a base according to the prior art.

With reference to FIG. 1, a prior art casting tree 10 is shown with a rubber base 12, a fusible material stem 14 and an enlarged diameter foot 16 securing the stem 14 to the base 12. Wax or plastic models 18 are secured to the stem 14 by short sprues 20. The sprues 20 are made of fusible material, for example, materials usually employed as casting waxes or plastics. As is usual, the sprues 20 are attached to both the stem 14 and the models 18, for example, by fusing the opposite ends thereto.

Figure 2:
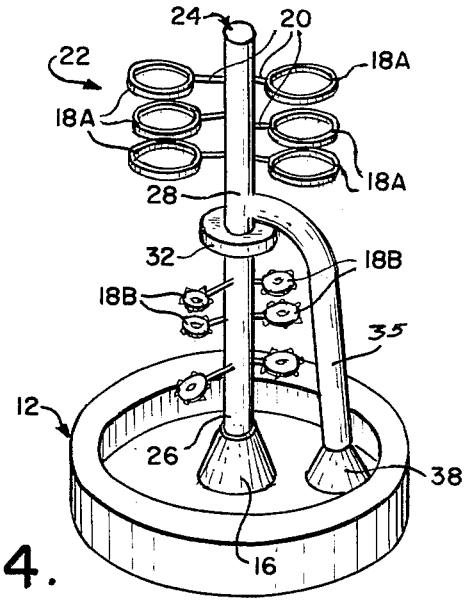
FIG. 2 is a perspective view of the tree according to the present invention showing a separator dividing the stem into a first portion and a second portion, and an auxiliary branch extending from the base to the second or upper portion.

As shown in FIG. 2, a casting tree 22 according to one embodiment of the present invention is also generally formed with a rubber base 12 and a stem 24 to which wax or plastic models 18A, 18B are secured with short sprues 20. An enlarged diameter rubber foot 16 secures the stem 24 to the rubber base 12, and may be formed integral with the base.

Figure 3:
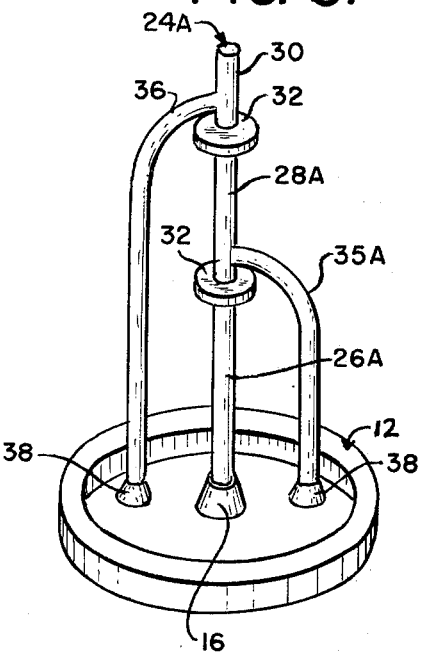
FIG. 3 is a view similar to FIG. 2 showing a tree with a stem divided into three portions to allow casting three types of metal at the same time, but without the casting models attached.
Figure 4:
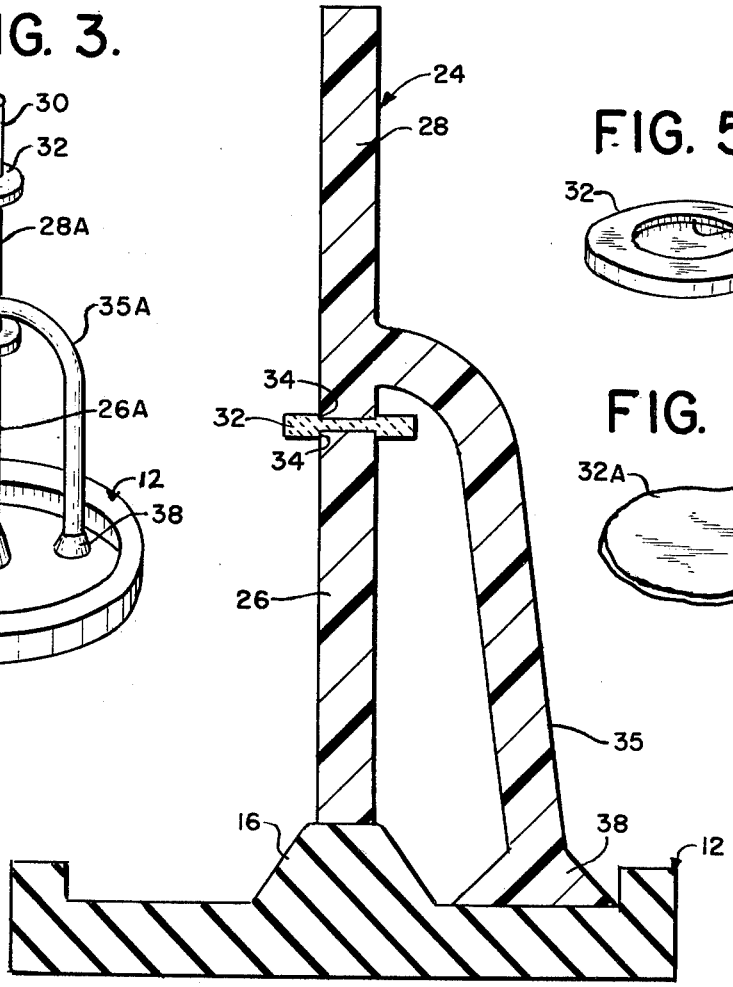
FIG. 4 is a sectional view of FIG. 2 without the casting models attached.

However, with reference to FIGS. 2 and 4, the stem 24 of the present invention is divided into a first or lower portion 26, and a second or upper portion 28. As will be obvious from the following discussion, there may be any number of stem portions, controlled only by considerations of the requirements of the jewelry being cast and the dimensions of the casting equipment. Thus, as shown in FIG. 3, the stem may be divided into three portions 26A, 28A, 30, or in an analogous manner, more portions as desired.

Figure 5A:
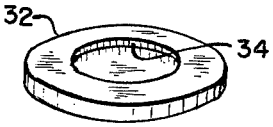
FIG. 5A and FIG. 5B are perspective views of two types of suitable non-fusible separators which may be used to divide the stem into separate portions.
Figure 5B:
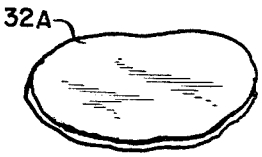

As in the prior art, the stem 24 is made of fusible material such as usually employed wax or plastic casting substances. However, the portions 26, 28 are separated from one another by a non-fusible separator 32 which is advantageously formed of a ceramic material. Ceramic materials are preferred because they have good temperature resistance characteristics, and will not introduce impurities into the recovered gold from the castings as may occur with metal separators. The stem portions 26, 28 are secured to the separator 32 by melting or by adding a small piece of wax. The separator 32 may be formed as a disc having upper and lower receiving depressions 34, 34 as shown in FIGS. 4 and 5A, or it may simply be a chip or piece of ceramic or other non-fusible material 32A, as shown in FIG. 5B.

With reference to FIGS. 2 and 4, the present invention device includes an auxiliary branch 35 extending between base 12 and upper stem portion 28. Auxiliary branch 35 has associated therewith an enlarged diameter auxiliary branch foot 38 which is similar to and may be identical to the stem foot 16 to secure the lower end of the branch to the base 12. The opposite end of branch 35 is fused to upper stem portion 28 in the region adjacent separator 32.

As will be obvious from the discussion of the use of the present invention device, each enlarged diameter foot 16, 38, may take any form but is preferably in a generally truncated conical form as shown in the drawings. The generally truncated conical form facilitates withdrawal of the foot 16 from the completed investment mold, as will be discussed in more detail below. In general, as commercially available bases 12 have a rubber foot pre-formed therein, it is presently preferred that the stem foot 16 be of rubber material formed as part of the base 12 for practical reasons. However, foot 16 may be formed of casting wax or plastic, in which event, it will be removed from the mold by melting, as hereinafter explained. The auxiliary branch foot 38 may also be formed of casting wax or plastic, along with the auxiliary branch 35, and thereafter secured to the commercially available base 12 by fusion. This arrangement permits simple modification of presently available equipment for use in practicing the present invention. However, foot 38 could be formed of rubber, similar to foot 16, in which event, it will be withdrawn from the completed investment mold.

For the tree illustrated in FIG. 2, the dimensions chosen were as follows: the base had a diameter of 4.5 inches (11.4 cm) and a collar height of 0.8 inches (2.0 cm); the foot had a height of 0.5 inches (1.3 cm) and the overall height of the stem was 5.5 inches (14.0 cm). The diameter of the stem was 0.4 inches (1.0 cm). All of the above dimensions are approximate and are not to be deemed limitations on the invention.

METHOD OF USE

Figure 6:
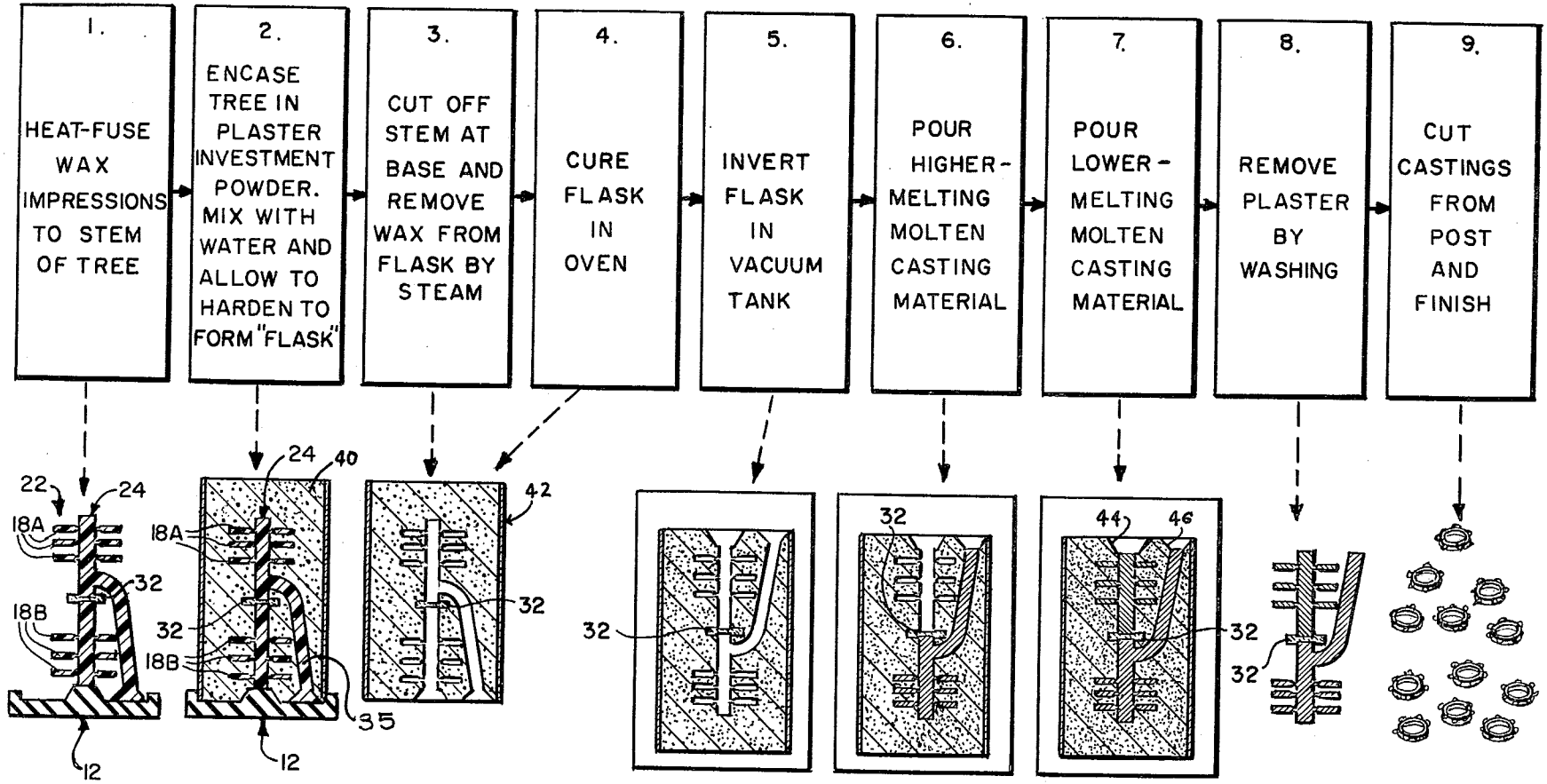
FIG. 6 is a diagrammatic representation of a preferred method for use of the present invention device.

The present invention casting tree 22 is preferably used in a casting method similar to the presently practiced prior art method except that the use of the present invention tree results in a tandem mold casting flask into which two different types of molten casting material may be poured, in sequence. With reference to FIG. 6, the presently preferred method of casting several different metals in the same casting flask is as follows:

1. Wax impressions 18A, 18B are heat-fused to the stem 24 of a casting tree 22 as described above, utilizing short sprues. Normally, the parts that are to be cast in the higher temperature melting material are secured to the upper portion of stem 24 while the items to be cast of the lower melting alloys are secured to the lower portion of the stem. This arrangement is preferred to that when the flask is inverted to receive molten casting metal, the mold which is to receive the higher melting alloy, which is usually poured first, is located at the bottom of the casting flask.

2. The assembled tree 22 is then encased with plaster powder 40 which is called investment. The investment is mixed with water and the composition hardens to form what is normally termed a "flask" 42.

3. The base 12 is cut or broken away from the flask 42, and the wax or other fusible material used to form the tree 22 is then removed from the flask 42 by melting, normally with the aid of steam.

4. The flask 42 is then cured, usually in an oven, to remove excess water and to thereby set the investment mold. At this point, the flask 42, formed of cured investment material, will function as a cavity or mold for receiving the material to be cast. As part of the curing step, the flask is heated for a period of time (4 hrs.–12 hrs.) and brought to a temperature compatible with the characteristic of the material being cast. In casting materials having different melting points, the flask should be at a temperature to first permit pouring of the casting material having the higher melting point.

5. The flask 42 is inverted and normally positioned in a vacuum tank which, during pouring of the molten casting material, assists in drawing metal into the mold. As would be obvious, other methods of causing the molten casting material to flow completely into the mold, as are normally employed, may be used.

6. As can be seen in FIG. 6, the cavity formed in the investment material is a tandem mold separated by a piece of ceramic material 32 which serves to prevent the flow of molten metal from one portion of the mold to the other portion. Each portion of the mold has a separate inlet represented by numbers 44 and 46. The higher melting molten casting material is normally poured first and into the lowermost cavity of the inverted flask.

7. After the higher melting casting alloy (i.e. white gold) is poured into the flask, a short period of time is permitted to lapse until the flask cools to a temperature to receive the lower melting casting alloy (i.e. yellow gold). The short waiting period is required for gold castings because ideally the flask should be a certain temperature at the time each specific melting point alloy is poured. Depending on the characteristics of the casting materials, the temperature of the flask may be between 600° F. to 1300° F.

8. The investment material or plaster 40 is then removed from the cooled casting, normally by washing, to release the cast metal tree.

9. The final steps in preparing the parts for assembly involve cutting the castings from the post formed by the mold outline of the stem of the tree, and polishing the parts.

This method was devised for use especially where two dissimilar colored metals are to be cast for later assembly as a single piece of jewelry, and therefore, the final step in forming the jewelry involves assembling the various parts which have been cast together in a single casting flask to form the finished item.

While a preferred embodiment of the invention has been shown and described in detail, it will be readily understood and appreciated that numerous omissions, changes and additions may be made without departing from the spirit and scope of the present invention. For example, FIG. 3 illustrates a tree formed of a stem 24A which has been divided into three portions 26A, 28A and 30 by means of separators 32. Auxiliary branch 35A extends between base 12 and intermediate stem portion 28A; and auxiliary branch 36 extends between base 12 and upper branch 30. Thus, the tree of FIG. 3 forms a mold which permits sequential casting of three different melting point alloys in the same flask.

What is claimed is:

1. A casting tree for tandem mold casting of separate articles from different materials, said tree comprising:

a base;

an upstanding stem mounted to said base, said stem having a first portion and a second portion;

a non-fusible separator positioned between said first stem portion and said second stem portion;

said first stem portion being of fusible material and having one end mounted to said base and the opposite end mounted to said separator, said first stem portion adapted to receive at least one model of fusible material corresponding to a first one of the articles to be cast;

said second stem portion being of fusible material and having one end mounted to said separator and the opposite end extending therefrom, said second stem portion adapted to receive at least one model of fusible material corresponding to a second one of the articles to be cast;

said separator separating said second stem portion in spaced relation to said first stem portion for blocking communication between the part of the tandem mold defined by said first stem portion and the part of the mold defined by said second stem portion; and an auxiliary branch being of fusible material and having one end mounted to said base and the opposite end mounted to the second portion of said stem.

2. The casting tree of claim 1 further comprising:

a stem foot, of larger cross-section than said stem, mounting said stem to said base; and an auxiliary branch foot, of larger cross-section than said auxiliary branch, mounting said branch to said base.

3. The casting tree of claim 2 wherein each said foot is in the form of a truncated cone.

4. The casting tree of claim 1 or 2 wherein said stem has a third portion formed of fusible material separated from said second stem portion by a second non-fusible separator, said third stem portion adapted to receive at least one model of fusible material corresponding to a third one of the articles to be cast; and a second auxiliary branch being formed of fusible material and having one end mounted to said base and the opposite end mounted to the third portion of said stem.

5. The casting tree of claim 1 or 2 wherein said first and second stem portions are in substantially vertical alignment.

6. The casting tree of claim 1 or 2 wherein said fusible material is casting wax, and/or plastic.

7. The casting tree of claim 1 or 2 wherein said separator comprises ceramic material.

8. The casting tree of claim 7 wherein said base and said stem foot comprise rubber material.

9. The casting tree of claim 1 or 2 wherein said stem is centrally mounted on said base.

10. A method for casting two different materials in the same casting flask using a casting tree of the type having a base; an upstanding stem mounted to the base having a first portion and a second portion separated by a nonfusible separator, the first portion extending between the separator and the base, and the second portion extending outwardly from the separator; and an auxiliary branch extending between the second portion and the base; said method comprising the steps of:

attaching models of pieces to be cast in a first material to sprues which are secured to the first portion of the stem;

attaching models of pieces to be cast in a second material to sprues which are secured to the second portion of the stem;

forming a casting flask with the casting tree having the model pieces attached;

forming a two-part casting mold by removing the casting tree from the flask, leaving the separator behind to separate the resulting mold into first and second non-communicating sections whereby molten casting material poured into one of said sections will be restrained from flowing into the other one of said sections; the removal of the first stem portion from the flask forming a conduit to said first mold section; and the removal of the auxiliary branch from the flask forming a conduit to said second mold section;

pouring one of the casting materials into said second mold section through the conduit formed by the removal of said auxiliary branch;

pouring a second of said casting materials into the first section of said mold through the conduit formed by the removal of said first stem portion;

allowing the casting materials to harden; and freeing the hardened casting material from the mold.

11. The method of claim 10 wherein said casting tree comprises fusible portions, and wherein the step of removing the casting tree from the flask includes heating said flask thereby to melt said fusible portions.

12. The method of claim 10 wherein the step of forming the casting flask comprises encasing the tree in plaster investment powder, adding water to said powder, and permitting said mixture to harden.

13. The method of claim 10 or 11 wherein the step of removing the casting tree from the flask includes curing the flask by application of heat.

14. The method of claim 10 wherein the steps of pouring the casting materials into said mold sections further comprises inverting said mold in a vacuum device and applying a vacuum to the mold to assist the flow of said materials into said mold.

15. The method of claim 10 wherein said first casting material is molten metal with a higher meling point than said second casting material.

16. The method of claim 10 wherein said first casting material is white gold and said second casting material is yellow gold.

* * * * *